US010722013B2

(12) United States Patent
Yang et al.

(10) Patent No.: US 10,722,013 B2
(45) Date of Patent: Jul. 28, 2020

(54) EXPANDABLE BAG INCLUDING SHAPE MEMORY FABRIC

(71) Applicants: Jinrong Yang, Shanghai (CN); Ramzi Khalil Maalouf, Chevy Chase, MD (US)

(72) Inventors: Jinrong Yang, Shanghai (CN); Ramzi Khalil Maalouf, Chevy Chase, MD (US)

( * ) Notice: Subject to any disclaimer, the term of this patent is extended or adjusted under 35 U.S.C. 154(b) by 239 days.

(21) Appl. No.: 15/861,494

(22) Filed: Jan. 3, 2018

(65) Prior Publication Data

US 2018/0184772 A1 Jul. 5, 2018

Related U.S. Application Data

(60) Provisional application No. 62/442,074, filed on Jan. 4, 2017.

(51) Int. Cl.

| | |
|---|---|
| ***A45C 3/02*** | (2006.01) |
| ***A45C 7/00*** | (2006.01) |
| ***A45C 3/04*** | (2006.01) |
| ***A45C 13/30*** | (2006.01) |
| ***A45C 13/00*** | (2006.01) |
| ***A45F 3/02*** | (2006.01) |
| ***A45C 1/02*** | (2006.01) |
| *A45C 11/00* | (2006.01) |

(52) U.S. Cl.

CPC ..... *A45C 7/0063* (2013.01); *A45C 1/02* (2013.01); *A45C 3/04* (2013.01); *A45C 13/001* (2013.01); *A45C 13/30* (2013.01); *A45F 3/02* (2013.01); *A45C 2011/002* (2013.01); *A45C 2011/003* (2013.01); *A45C 2200/00* (2013.01)

(58) Field of Classification Search

CPC ..... A45C 7/0063; A45C 3/001; A45C 13/001
USPC ..... 383/4, 33; 190/103, 40
See application file for complete search history.

(56) References Cited

U.S. PATENT DOCUMENTS

| | | | | |
|---|---|---|---|---|
| 5,749,446 | A * | 5/1998 | Hsieh | A45C 7/0022 190/103 |
| 6,015,072 | A * | 1/2000 | Young | A45C 7/0063 190/103 |
| 8,674,211 | B1 * | 3/2014 | Palmer | H02S 30/20 136/244 |
| 8,925,771 | B2 * | 1/2015 | Lin | A45C 7/0077 224/153 |
| 2005/0140331 | A1 * | 6/2005 | McQuade | A45C 15/00 320/101 |
| 2006/0273757 | A1 * | 12/2006 | Naguib | H02J 7/355 320/107 |

(Continued)

*Primary Examiner* — Sue A Weaver
(74) *Attorney, Agent, or Firm* — Dickinson Wright PLLC

(57) ABSTRACT

An expandable luggage bag including a first bag portion made of a first material that forms a first interior volume. The expandable luggage bag further includes a second bag portion made of a second material that has a first state having a first rigidity and a second state having a second rigidity different than the first rigidity. The expandable luggage bag further includes a solar panel in selective electrical communication with the second bag portion. The second bag portion is in the first state when the second bag portion is not in electrical communication with the solar panel. The second bag portion is in the second state when the second bag portion is in electrical communication with the solar panel.

20 Claims, 6 Drawing Sheets

(56) References Cited

U.S. PATENT DOCUMENTS

| | | | | |
|---|---|---|---|---|
| 2008/0011799 | A1* | 1/2008 | Chang | A45C 15/00 224/576 |
| 2008/0182099 | A1* | 7/2008 | Lalli | B32B 37/12 428/327 |
| 2009/0139814 | A1* | 6/2009 | Grossman | A45C 7/0086 190/18 A |
| 2012/0042996 | A1* | 2/2012 | Glynn | A45C 15/00 150/106 |
| 2015/0101958 | A1* | 4/2015 | Cross | A45C 5/14 206/702 |
| 2015/0270728 | A1* | 9/2015 | Williams | H02J 7/0044 320/111 |
| 2017/0201021 | A1* | 7/2017 | Chiou | H01Q 5/30 |

* cited by examiner

EXPANDABLE BAG INCLUDING SHAPE MEMORY FABRIC

CROSS-REFERENCE TO RELATED APPLICATION AND CLAIM OF PRIORITY

This application claims benefit of priority to U.S. Provisional Application No. 62/442,047, filed Jan. 4, 2017, titled "Expandable Bag Including Shape Memory Fabric," the content of which is hereby incorporated by reference herein in its entirety and for all purposes.

BACKGROUND

The present invention relates to expandable luggage bags, for example a luggage bag such as a shoulder bag or a purse containing an expandable shopping bag or fashion bag.

Reusable shopping bags are becoming increasingly popular in an attempt to reduce the waste associated with disposable shopping bags. Reusable shopping bags are generally made of a lightweight, foldable fabric that typically wears out quickly, and are cumbersome to carry while shopping. Additionally, reusable shopping bags typically have flexible sides that provide little protection to goods or belongings transported within the shopping bag. Fashionable shoulder bags and purses have a fixed size. An expandable bag with shape memory fabric gives consumers the freedom to change the size and rigidity of their fashionable bags on the go, depending on their mood, application, or event.

SUMMARY

In one embodiment, the disclosure provides an expandable luggage bag including a first bag portion made of a first material and forming a first interior volume. The expandable luggage bag further includes a second bag portion made of a second material that has a first state having a first rigidity and a second state having a second rigidity different than the first rigidity. The expandable luggage bag further includes a solar panel in selective electrical communication with the second bag portion. The second bag portion is in the first state when the second bag portion is not in electrical communication with the solar panel. The second bag portion is in the second state when the second bag portion is in electrical communication with the solar panel.

In another embodiment, the disclosure provides an expandable luggage bag forming a first interior volume in a storage state and a second interior volume in an expanded state. The second interior volume is larger than the first interior volume. The expandable luggage bag includes a first bag portion made of a first material and forming the first interior volume. The expandable luggage bag further includes a second bag portion made of a second material and having a first state corresponding to the storage state and a second state corresponding to the expanded state. The second bag portion forms the second interior volume when the second bag portion is in the second state. The expandable luggage bag further includes a solar panel in selective electrical communication with the second bag portion. The second bag portion is in the first state when the second bag portion is not in electrical communication with the solar panel.

In yet another embodiment, the disclosure provides a method of transforming an expandable luggage bag between an expanded state and a storage state. The method includes the step of providing a first bag portion made of a first material and forming a first interior volume. The method further includes the step of opening the first bag portion to expose a second bag portion positioned within the first interior volume. The second bag portion is made of a second material having a first state corresponding to the storage state and a second state corresponding to the expanded state. The method further includes the step of transforming the second material from the first state to the second state using energy supplied by a solar panel, wherein the second state forms a second interior volume larger than the first interior volume.

Other aspects of the disclosure will become apparent by consideration of the detailed description and accompanying drawings.

DETAILED DESCRIPTION

Figure 1:
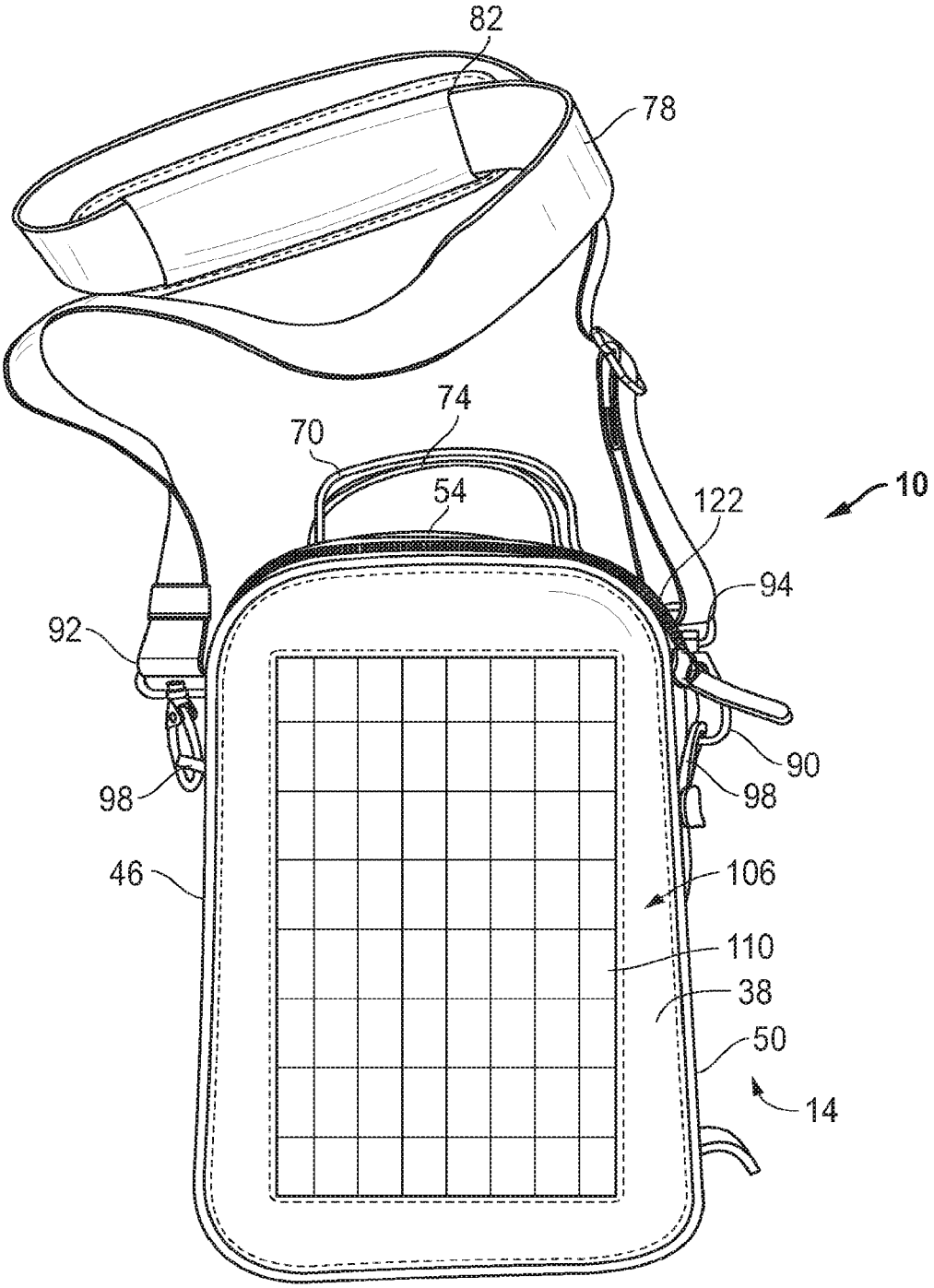
FIG. 1 is a front view of the expandable luggage bag in a storage position.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In any disclosed embodiment, the terms "substantially", "approximately", and "about" may be substituted with "within a percentage of" what is specified, where the percentage includes 0.1, 1, 5, and 10 percent. The terms "bag" and "bag portion" are generally used to mean a receptacle enclosing an interior volume.

FIGS. 1-4 show an expandable luggage bag 10 according to one embodiment. The term "expandable" is used to generally refer to a luggage bag that is adjustable to form a first, relatively small interior volume and a second, relatively large interior volume. The expandable luggage bag 10 includes a first bag portion 14 and a second bag portion 18. The expandable luggage bag 10 is adjustable between a storage position (FIG. 1) and an expanded position (FIGS. 3-6). When the expandable luggage bag 10 is in the storage position, the first bag portion 14 forms an interior cavity 30 having a first interior volume, as described below. The second bag portion 18 is received within the interior cavity 30 of the first bag portion 14. When the expandable luggage bag 10 is in the expanded position, the second bag portion 18 forms an interior cavity 34 having a second interior volume larger than the first interior volume, as described below.

The first bag portion 14 includes a front panel 38, a rear panel 42, a first side panel 46, a second side panel 50, a top panel 54, and a bottom panel 58. The term "panel" is generally used to refer to a substantially planar portion of material used to form the first bag portion 14 or the second bag portion 18. The term "planar portion" should be interpreted as the best fit of a plane across the panel, even if the panel is curved, multifaceted, or otherwise non-planar. The front panel 38, the rear panel 42, the first side panel 46, the second side panel 50, the top panel 54, and the bottom panel 58 form the cavity 30 having the first interior volume. A zipper 62 extends along the top panel 54, the first side panel 46, the bottom panel 58, and a portion of the second side panel 50 so that, when unzipped, the front panel 38 may be pivoted about an axis 66 of the second side panel 50 so that the front panel 38 and the rear panel 42 may form a substantially flat surface. In the illustrated embodiment, the first bag portion 14 is made of a material such as leather, nylon, canvas, polyester, or hard plastic.

Figure 2:
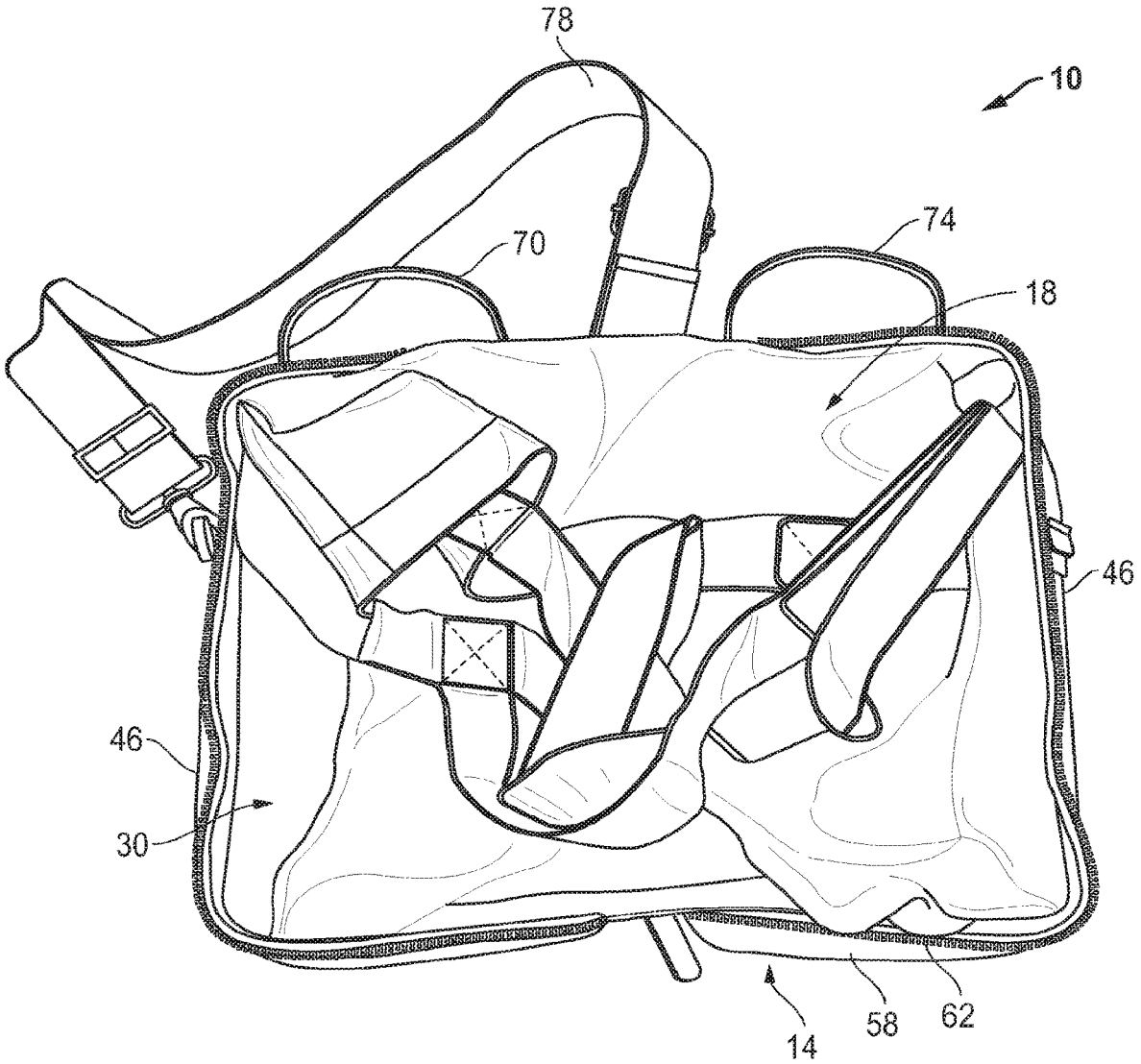
FIG. 2 is a perspective view of the expandable luggage bag in an open position.
Figure 3:
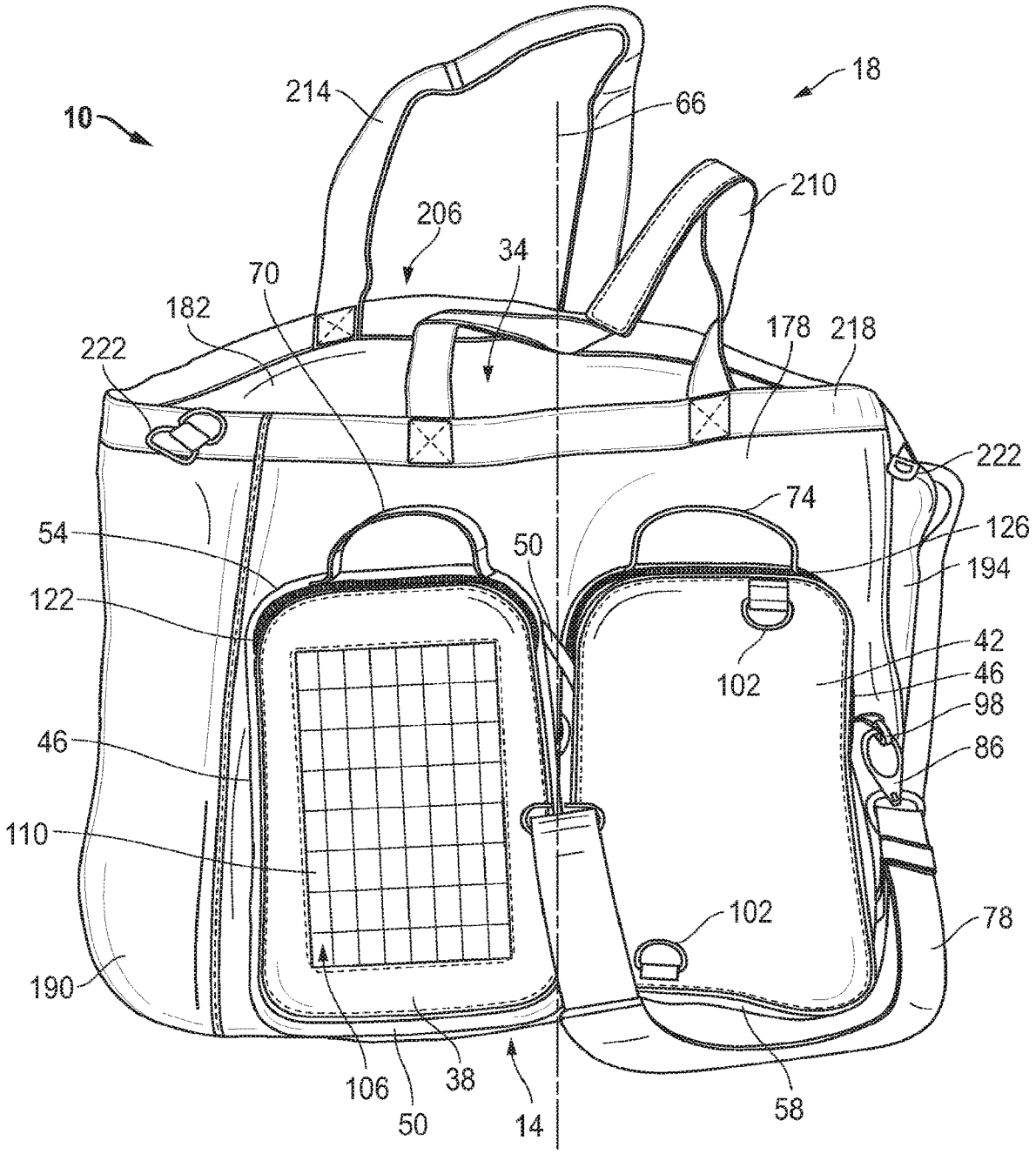
FIG. 3 is a perspective view of the expandable luggage bag in an expanded position.

With continued reference to FIGS. 1-4, the top panel 54 may include a first handle 70 and a second handle 74 graspable by a user. The expandable luggage bag 10 may also include a strap 78. The strap 78 may include a pad 82, a first clip 86, and a second clip 90. The pad 82 is movable along a length of the strap 78 and may be positioned on a shoulder of a user. The first clip 86 and the second clip 90 are positioned at a first end 92 and a second end 94 of the strap 78, respectively. The strap 78 may be releasably connected to the first bag portion 14 by the first clip 86 and the second clip 90. As shown in FIG. 3, the first side panel 46 and the second side panel 50 may include a first pair of connectors 98, such as D-rings, that may receive the first clip 86 and the second clip 90 of the strap 78. Similarly, the rear panel may include a second pair of connectors 102 that may receive the first clip 86 and the second clip 90. The first clip 86 and the second clip 90 include a substantially resilient portion and a substantially rigid portion. The resilient portion is displacable to allow one of the pairs of connectors 98, 102 to pass into an interior of the first and second clips 86, 90.

The expandable luggage bag 10 may be used without the strap 78, or the strap 78 may be removed from one pair of clips and attached to another pair of clips to change an orientation of the expandable luggage bag 10 with respect to the user's body. For example, the first clip 86 and the second clip 90 of the strap 78 may be attached to the first pair of connectors 98 to orient the expandable luggage bag 10 so that the top panel 54 is facing upwards, as shown in FIG. 1. Alternatively, the first clip 86 and the second clip 90 of the strap 78 may be attached to the second pair of connectors 102 to orient the expandable luggage bag 10 so that the rear panel 42 lies along a user's body and either the first side panel 46 or the second side panel 50 faces upward.

As shown in FIG. 1, the front panel 38 includes a solar panel 106. The solar panel 106 includes a plurality of solar cells 110 configured to convert light energy (e.g. energy from sunlight or bright interior lights) into electricity. The solar cells 110 may be electrically connected in series to produce a desired voltage or in parallel to produce a desired current. The solar panel 106 may be rigid, flexible, or a combination of rigid and flexible. In the illustrated embodiment, the solar panel 106 is sewn to the front panel 38 of the first bag portion 14. In alternate embodiments, the solar panel may be glued to the front panel 38 or secured to the front panel 38 using fastening members such as studs or screws. In other embodiments, the rear panel 42 may also include a solar panel.

Figure 4:
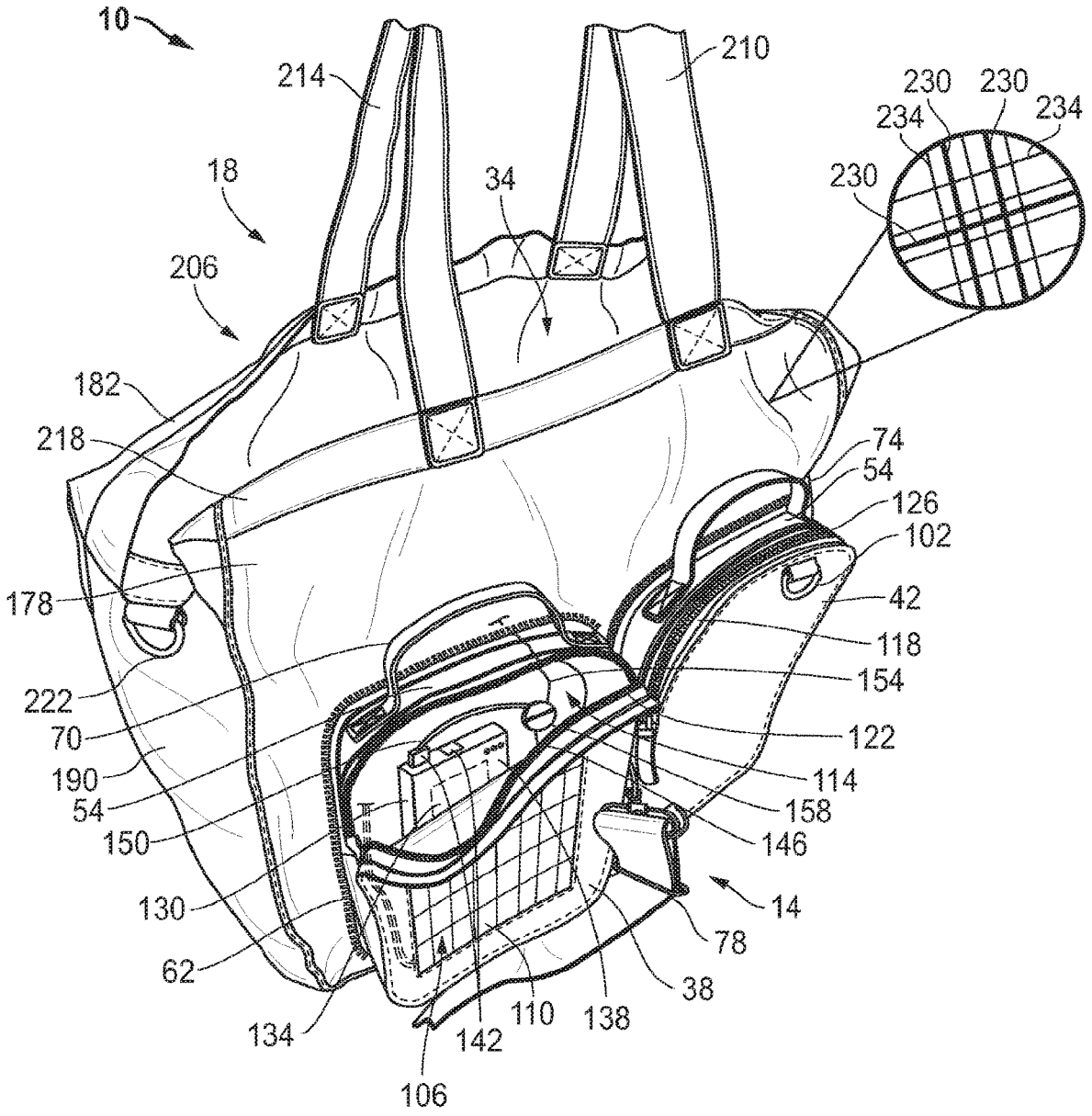
FIG. 4 is another perspective view of the expandable luggage bag of FIG. 3 in the expanded position.

As shown in FIGS. 3-4, the front panel 38 includes a front pocket 114 and the rear panel 42 includes a rear pocket 118. In the illustrated embodiment, the front pocket 114 and the rear pocket 118 include zippered openings 122, 126, respectively. In alternate embodiments, the front pocket 114 and the rear pocket 118 may have openings that are not closable, or openings that are closable by other closure mechanisms, such as snaps, drawstrings, or buttons.

As shown in FIG. 4, a rechargeable battery pack 130 is positioned in the front pocket 114. The rechargeable battery 134 may be a lithium ion battery, a lithium polymer battery, a nickel cadmium battery, a nickel-metal hydride battery, or a lead acid battery. Other rechargeable battery types or compositions may be used. The rechargeable battery pack 130 may be 12V, 18V, or 24V, although other sizes may be used. The rechargeable battery pack 130 includes indicia 138 indicative of the charge of the rechargeable battery 134. For example, a green LED engaged with the rechargeable battery pack 130 may indicate a fully charged battery, an orange LED engaged with the rechargeable battery pack 130 may indicate a moderately charged battery, and a red LED engaged the rechargeable battery pack 130 may indicate a low battery charge. Alternatively, the rechargeable battery pack 130 may be adapted to produce an audible sound indicative of a low battery charge. The rechargeable battery pack 130 includes a connection port 142 such as an USB port for a connection to the second bag portion 18 or a peripheral electronic device such as a tablet computer, a smartphone, or an audio player. In some embodiments, the rechargeable battery pack 130 is optional.

With continued reference to FIG. 4, a first insulated wire 146 connects the solar panel 106 to a switch 158. A second insulated wire 150 connects the rechargeable battery pack 130 to the switch 158. A third insulated wire 154 connects the second bag portion 18 to the switch 158. The switch 158 has a first position in which the solar panel 106 is in electrical communication with the second bag portion 18, a second position in which the solar panel 106 is in electrical communication with the rechargeable battery pack 130, a third position in which the rechargeable battery pack 130 is in electrical communication with the second bag portion 18, and a fourth position that corresponds to an "off" position in which the solar panel 106 is not in electrical communication with the rechargeable battery pack 130 or with the second bag portion 18 and in which the rechargeable battery pack 130 is not in electrical communication with the second bag portion 18.

As shown in FIGS. 3-4, the second bag portion 18 includes a front panel 178, a rear panel 182, a bottom panel 186, a first side panel 190, and a second side panel 194. The front panel 178, the rear panel 182, the bottom panel 186, the first side panel 190, and the second side panel 194 form the interior cavity 34, which forms the second interior volume. The second interior volume is larger than the first interior volume. The second bag portion 18 has a storage state (FIG. 2) in which the second bag portion 18 is positioned within the first bag portion 14 and an expanded state (FIGS. 3-4) in which the second bag portion 18 forms the second interior volume. As shown in FIG. 3, the first bag portion 14 may form a portion of the front panel 178 of the second bag portion 18. In alternate embodiments, the first bag portion 14 may form the entire front panel 178, a portion of the rear panel 182, or the entire rear panel 182. As shown in FIG. 3, the second bag portion may have an open top 206. In other embodiments, the second bag portion 18 may include a closure mechanism such as a zipper, a drawstring, snaps, or buttons to restrict access to the interior cavity 34. The front panel 178 and the rear panel 182 include a first handle 210 and a second handle 214, respectively. The first handle 210 and the second handle 214 are positioned proximate a top 218 of the second bag portion 18 so that the open top 206 is the uppermost portion of the expandable luggage bag 10 when the user carries the expandable luggage bag 10 by the handles 210, 214. The first side panel 190 and the second side panel 194 include a third pair of connectors 222 for receiving the first clip 86 and the second clip 90 of the strap 78. The third pair of connectors 222 is positioned proximate the top 218 of the second bag portion 18 so that the open top 206 is the uppermost portion of the expandable luggage bag 10 when the user carries the expandable luggage bag 10 by the strap 78.

The second bag portion 18 is made of a shape memory material, such as a shape memory fabric or a shape memory polymer. Shape memory materials transition between an original shape ("remembered shape") and a deformed shape ("temporary shape") in response to a predetermined external stimulus such as heat, an electric field, or a magnetic field. In some embodiments, "triple shape memory polymers" are available to transition to third shape, in addition to the deformed shape. Shape memory fabrics are fabrics that include strands of shape memory alloys interwoven among the strands of a fabric material (e.g. nylon, cotton, canvas). As the shape memory alloys woven into the fabric material are exposed to the predetermined external stimulus to transition between the remembered shape and the temporary shape, the fabric material will move with the shape memory alloy strands to form the remembered shape or the temporary shape. Shape memory alloys are generally copper-aluminum-nickel (Cu—Al—Ni) or nickel-titanium (NiTi) alloys. Shape memory alloys may be created by alloying zinc, copper, gold, and iron to create, for example iron-manganese-silicon (Fe—Mn—Si) or copper-zinc-aluminum (Cu—Zn—Al) alloys.

The second bag portion 18, may, for example, be made of a fabric material including shape memory strands 230 made by a shape memory alloy interwoven among fabric fibers 234 of the fabric material, as shown in the detail of FIG. 4. Although FIG. 4 shows the shape memory strands 230 interwoven into the fabric fibers 234 in a pattern similar to a weave pattern of the fabric fibers 234, the shape memory strands 230 may also be interwoven into the fabric fibers 234 according to other patterns. For example, the interwoven shape memory strands 230 may form circular, wave-like, ziz-zag, spiral, or diagonal patterns. The shape memory material includes a relaxed state (FIG. 2) and a rigid or stiff state (FIG. 3). The terms "rigid" and "stiff" are generally used to refer to the extent to which a material resists deformation in response to an applied force. The term "relaxed" is generally used to refer to a material that weakly resists deformation in response to an applied force. In the illustrated embodiment, the shape memory material transitions between the relaxed state and the rigid state in response to the presence or absence of an electrical current. For example, the shape memory material may be in the relaxed state when substantially no electrical current is present in the shape memory material and in the rigid state when electrical current is present in the shape memory material. As shown schematically in the inset of FIG. 4, the shape memory strands 230 are interwoven with the fabric fibers 234 so that the rigid state corresponds to a self-supporting state of the second bag portion 18 in which the front panel 38, the rear panel 42, the first side panel 46, and the second side panel 50 are able to stand in a self-supporting manner and resist deformation. In alternate embodiments, the shape memory alloy may respond to other external stimuli, such as heat or a magnetic field.

To transform the expandable luggage bag 10 from the storage position (FIG. 1) to the expanded position (FIGS. 3-4), a user actuates the zipper 62 so that the front panel 38 of the first bag portion 14 is movable with respect to the rear panel 42 of the first bag portion 14. The user then rotates the front panel 38 about the axis 66 to open the expandable luggage bag 10 so that the front panel 38 is positioned adjacent the rear panel 42, thereby exposing the second bag portion 18 (FIG. 2). If the user is in an environment having sufficient light for the solar panel 106 to generate electricity, the user moves the switch 158 from the fourth ("off") position to the first position to put the solar panel 106 into electrical communication with the shape memory material of the second bag portion 18. In response to the electric current supplied by the solar panel 106, the shape memory material transitions from the relaxed state to the rigid state.

If the user is in an environment having insufficient light for the solar panel 106 to generate electricity, the user moves the switch 158 from the fourth ("off") position to the third position to put the rechargeable battery pack 130 into electrical communication with the shape memory material forming the second bag portion 18. In response to the current supplied by the rechargeable battery pack 130, the shape memory fabric transitions from the relaxed state to the rigid state.

To return the expandable luggage bag 10 to the storage position, the user moves the switch 158 from the first position to the fourth ("off") position to prevent electrical communication between the solar panel 106 and the second bag portion 18. Alternatively, the user moves the switch from the third position to the fourth position to prevent electrical communication between the rechargeable battery pack 130 and the second bag portion 18. When the shape memory material of the second bag portion 18 stops receiving current from the solar panel 106 or the rechargeable battery pack 130, the shape memory material transitions from the rigid state to the relaxed state. After the shape memory material has transitioned to the relaxed state, the user positions the second bag portion 18 within the front panel 38 and the rear panel 42 of the first bag portion 14. The user then pivots the front panel 38 about the axis 66 so that the front panel 38 is vertically stacked over the rear panel 42. The user then actuates the zipper 62 so that the front panel 38 is secured to the rear panel 42.

If the user is in an environment having sufficient light for the solar panel 106 to generate electricity, the user may move the switch 158 from the fourth position to the second position so that the solar panel 106 is in electrical communication with the battery 134 and is operable to charge the battery 134.

Figure 5:
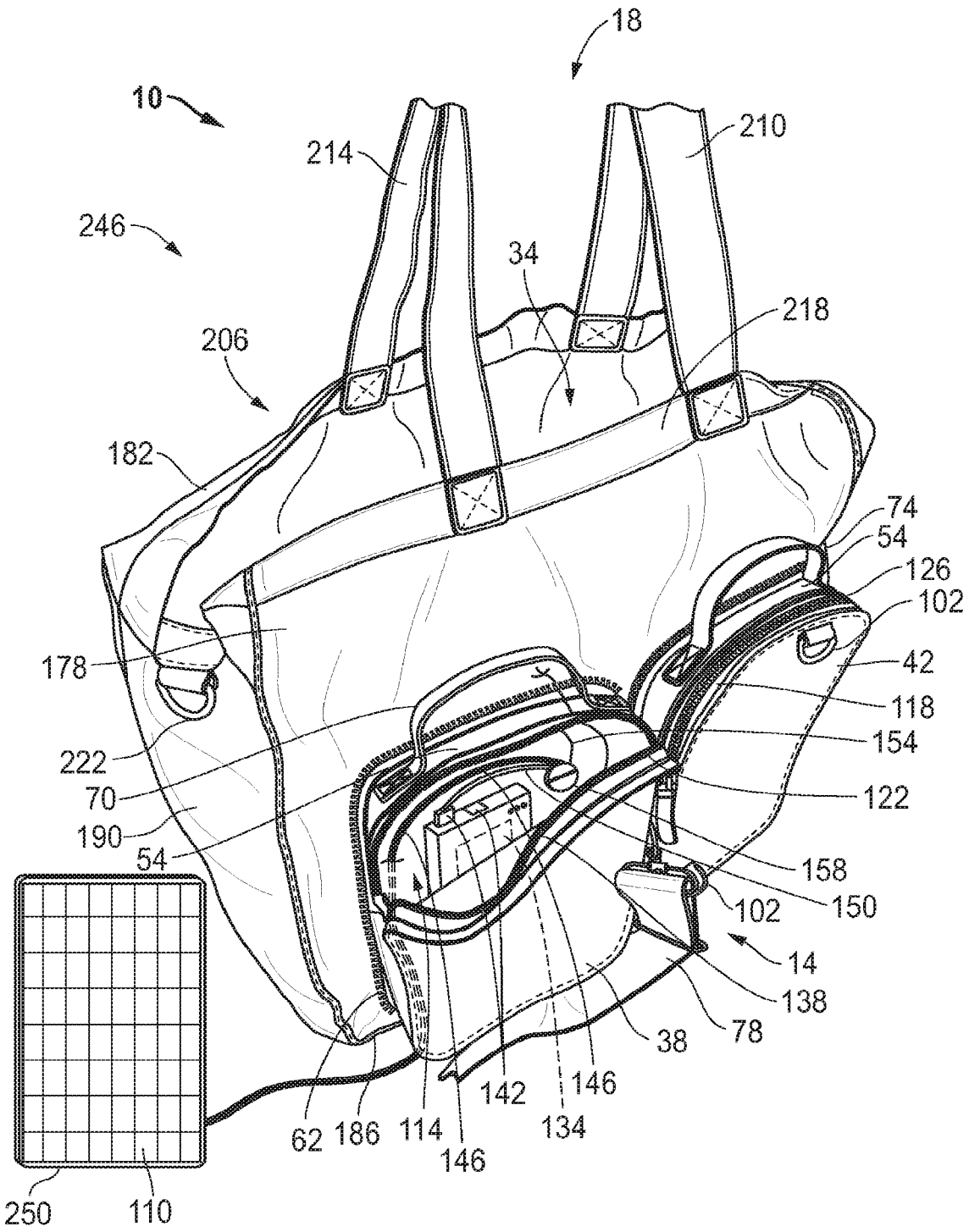
FIG. 5 is a perspective view of an expandable luggage bag according to another embodiment.

FIG. 5 illustrates another embodiment of an expandable luggage bag 246 according to the present disclosure. The expandable luggage bag 246 includes components analogous to the solar panel 106, the rechargeable battery pack 130, the switch 158, and the insulated wires 146, 150, 154, but the solar panel 250 is repositionable relative to the expandable luggage bag 246. The same reference numbers are used for convenience, it being understood that the first bag portion 14 and the second bag portion 18 in this embodiment may be different from those of the previous embodiment. The expandable luggage bag 246 is operated in a similar manner as the expandable luggage bag 10.

As shown in FIG. 5, the solar panel 106 is repositionable with respect to the expandable luggage bag 10. Accordingly, the solar panel 106 may be stored in the front pocket 114 when the solar panel 106 is not in use and the solar panel 106 may be removed from the front pocket 114 when electricity generated by the solar panel 106 is necessary to transform the memory shape fabric from the relaxed state (FIG. 1) to the rigid state (FIG. 5) or to charge the rechargeable battery pack 130. In some embodiments, the solar panel may be releasably connected to the front panel 38, for example by a fastener such as Velcro. As mentioned above, the rechargeable battery pack 130 is optional.

Figure 6:
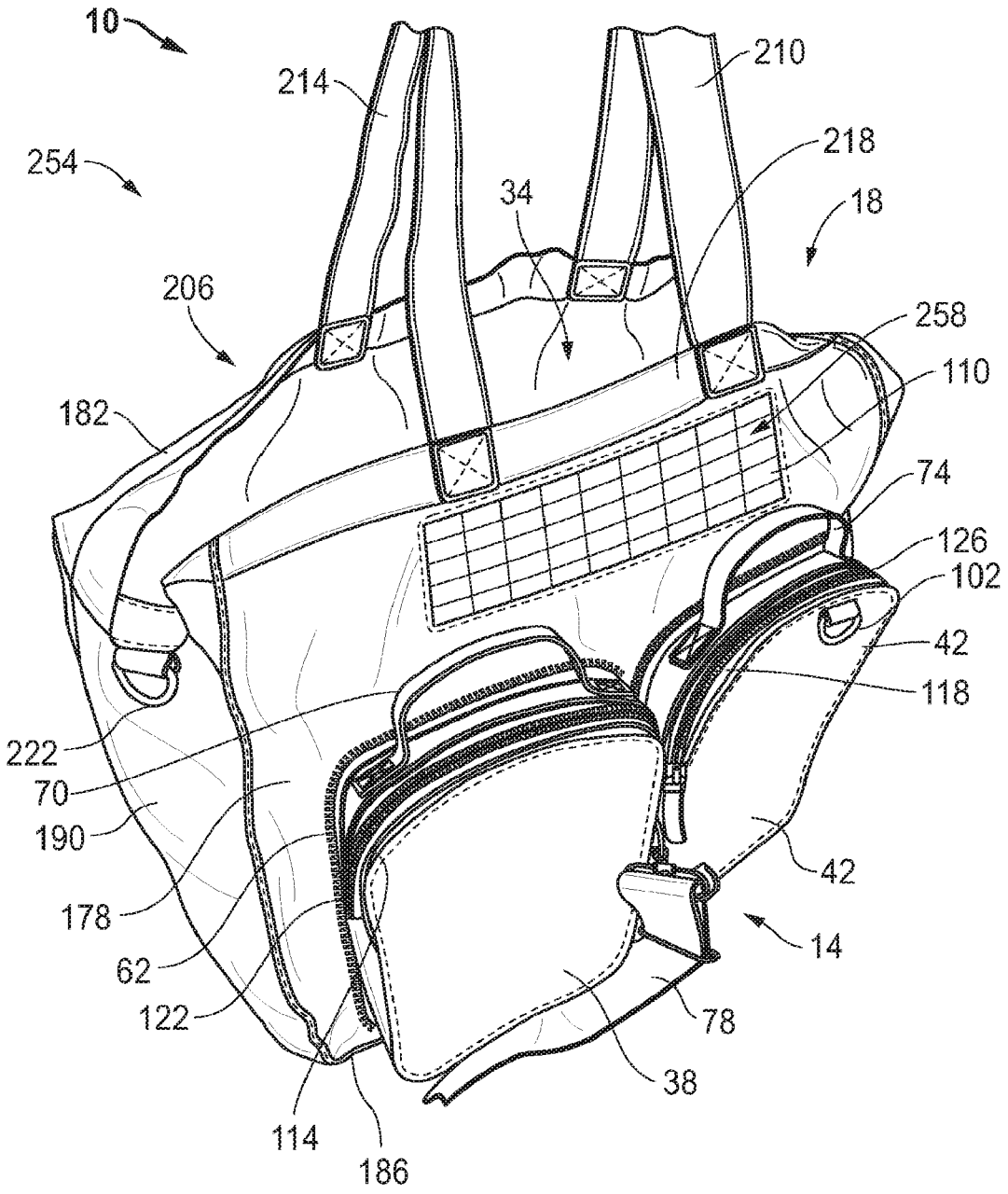
FIG. 6 is a perspective view of an expandable luggage bag according to yet another embodiment.

FIG. 6 illustrates another embodiment of an expandable luggage bag 254 according to the present disclosure. The expandable luggage bag 254 includes a solar panel 258 analogous to the solar panel 106, but the solar panel 258 is positioned on the front panel 38 of the second bag portion 18 of the expandable luggage bag 10. The same reference numbers are used for convenience, it being understood that the first bag portion 14 and the second bag portion 18 in this embodiment may be different from those of the previous embodiment.

As shown in FIG. 6, the solar panel 258 is positioned on the front panel 38 of the second bag portion 18 so that the solar panel 258 is exposed to light when the second bag portion 18 is in the expanded state (FIG. 6) and positioned within the first bag portion 14 when the second bag portion 18 is in the storage state (FIG. 1). The expandable luggage bag 254 may not include a battery or a switch, as is shown in FIG. 6. Alternatively, the expandable luggage bag 254 may optionally include a rechargeable battery pack 130 for storing electricity generated by the solar panel 250 as discussed above with respect to the expandable luggage bag 10.

To transform the expandable luggage bag 254 from the storage position (FIG. 1) to the expanded position (FIG. 6), a user actuates the zipper 62 so that the front panel 38 of the first bag portion 14 is movable with respect to the rear panel 42 of the first bag portion 14. The user then rotates the front panel 38 about the axis 66 to open the expandable luggage bag 254 so that the front panel 38 is positioned adjacent the rear panel 42, thereby exposing the second bag portion 18 and the solar panel 258. In response to the electric current supplied by the solar panel 106, the shape memory material transitions from the relaxed state (FIG. 2) to the rigid state (FIG. 6).

To return the expandable luggage bag 254 to the storage position, the user prevents light from reaching the solar cells 110 of the solar panel 258, for example by placing a hand over the solar panel 258. When the shape memory material of the second bag portion 18 stops receiving current from the solar panel 258, the shape memory material transitions from the rigid state (FIG. 6) to the relaxed state (FIG. 2). After the shape memory material has transitioned to the relaxed state, the user positions the second bag portion 18 within the front panel 38 and the rear panel 42 of the first bag portion 14. The user then pivots the front panel 38 about the axis 66 so that the front panel 38 is vertically stacked over the rear panel 42. The user then actuates the zipper 62 so that the front panel 38 is secured to the rear panel 42.

Various features and advantages of the invention are set forth in the following claims.

What is claimed is:

1. An expandable luggage bag comprising:

a first bag portion made of a first material;

a second bag portion attached to the first bag portion, the second bag portion made of a second material comprising a shape memory material; and a solar panel configured to electrically communicate with the second bag portion;

wherein the shape memory material comprises a first state of rigidity when the second bag portion does not electronically communicate with the solar panel and a second state of rigidity when the second bag portion electronically communicates with the solar panel.

2. The expandable luggage bag of claim 1, wherein the second state of rigidity is larger than the first state of rigidity.

3. The expandable luggage bag of claim 2, wherein the second bag portion is positionable within the first bag portion when the second bag portion is in the first state of rigidity.

4. The expandable luggage bag of claim 1, wherein the solar panel is positioned on an exterior of the first bag portion.

5. The expandable luggage bag of claim 1, wherein the solar panel is positioned on an exterior of the second bag portion.

6. The expandable luggage bag of claim 1, further comprising a battery configured to receive electrical energy from the solar panel and discharge electrical energy to a peripheral device.

7. The expandable luggage bag of claim 6, wherein the peripheral device is the second bag portion.

8. The expandable luggage bag of claim 6, further comprising a switch configured to enable electrical communication between the solar panel and the battery and enable electrical communication between the battery and the second bag portion.

9. The expandable luggage bag of claim 1, further comprising a switch configured to enable electrical communication between the solar panel and the second bag portion and enable electrical communication between the solar panel and the second bag portion.

10. The expandable luggage bag of claim 1, wherein the second material further comprises fabric fibers interwoven among stands of the shape memory material.

11. An expandable luggage bag forming a first interior volume in a storage state and a second interior volume in an expanded state, the second interior volume being larger than the first interior volume, the expandable luggage bag comprising:

a first bag portion made of a first material and forming the first interior volume;

a second bag portion attached to the first bag portion, the second bag portion made of a second material comprising a shape memory material, the second bag portion forming the second interior volume when the second bag portion is in the second state; and a solar panel configured to electrically communicate with the second bag portion;

wherein the shape memory material comprises a first state of rigidity when the second bag portion does not electronically communicate with the solar panel and a second state of rigidity when the second bag portion electronically communicates with the solar panel, the first state of rigidity corresponding to the storage state and the second state of rigidity corresponding to the expanded state.

12. The expandable luggage bag of claim 11, wherein the second state of rigidity is larger than the first state of rigidity.

13. The expandable luggage bag of claim 11, wherein the solar panel is positioned on an exterior of the first bag portion.

14. The expandable luggage bag of claim 11, further comprising a battery configured to receive electrical power from the solar panel and discharge electrical energy to a peripheral device or to the second bag portion.

15. The expandable luggage bag of claim 11, wherein the second material further comprises fabric fibers interwoven among stands of the shape memory material.

16. A method of transforming an expandable luggage bag between an expanded state and a storage state, the method comprising:

providing a first bag portion made of a first material and forming a first interior volume;

opening the first bag portion to expose a second bag portion positioned within the first interior volume, the second bag portion made of a second material comprising a shape memory material; and transforming the shape memory material from a first state of rigidity corresponding to the storage state to a second state of rigidity corresponding to the expanded state using energy supplied by a solar panel, wherein the second bag portion forms a second interior volume larger than the first interior volume when the shape memory material is in the second state of rigidity.

17. The method of claim 16, further comprising the steps of:

transforming the shape memory material from the second state of rigidity to the first state of rigidity by preventing electrical communication between the solar panel and the second bag portion; and positioning the second bag portion within the first interior volume of the first bag portion when the shape memory material is in the first state of rigidity.

18. The method of claim 16, further comprising the steps of:

storing energy supplied by the solar panel in a battery; and transforming the shape memory material from the first state of rigidity to the second state of rigidity using energy stored in the battery.

19. The method of claim 16, wherein transforming the shape memory material from the first state of rigidity to the second state of rigidity comprises:

positioning a switch to put the solar panel in electrical communication with the second bag portion.

20. The method of claim 18, wherein transforming the shape memory material from the first state of rigidity to the second state of rigidity comprises:

positioning a switch to put the battery in electrical communication with the second bag portion.

* * * * *